US011358614B2

(12) United States Patent
Erharter et al.

(10) Patent No.: US 11,358,614 B2
(45) Date of Patent: Jun. 14, 2022

(54) CABLE TRANSPORTATION SYSTEM

(71) Applicant: LEITNER S.P.A., Vipiteno (IT)

(72) Inventors: Nikolaus Erharter, San Candido (IT); Alberto Casetta, Vipiteno (IT)

(73) Assignee: LEITNER S.P.A., Vipiteno (IT)

( * ) Notice: Subject to any disclaimer, the term of this patent is extended or adjusted under 35 U.S.C. 154(b) by 346 days.

(21) Appl. No.: 16/750,814

(22) Filed: Jan. 23, 2020

(65) Prior Publication Data

US 2020/0239034 A1 Jul. 30, 2020

(30) Foreign Application Priority Data

Jan. 24, 2019 (IT) ..... 102019000001097

(51) Int. Cl.

| | |
|---|---|
| ***B61B 12/06*** | (2006.01) |
| ***B61B 7/00*** | (2006.01) |
| ***B61B 12/02*** | (2006.01) |
| ***B61L 23/04*** | (2006.01) |

(52) U.S. Cl.

CPC ..... *B61B 12/06* (2013.01); *B61B 7/00* (2013.01); *B61B 12/028* (2013.01); *B61L 23/04* (2013.01)

(58) Field of Classification Search

CPC .... B61B 1/00; B61B 1/02; B61B 3/00; B61B 7/00; B61B 12/00; B61B 12/02; B61B 12/022; B61B 12/024; B61B 12/028; B61B 12/06; B61L 23/04; B61L 23/042

See application file for complete search history.

(56) References Cited

U.S. PATENT DOCUMENTS

| | | | | |
|---|---|---|---|---|
| 7,082,880 | B2 * | 8/2006 | Schertler | B61B 12/028 105/149.1 |
| 7,802,523 | B2 | 9/2010 | Moritzhuber et al. | |

FOREIGN PATENT DOCUMENTS

| | | | | |
|---|---|---|---|---|
| EP | 1034996 | A1 * | 9/2000 | B61B 1/02 |
| EP | 1 837 264 | | 9/2007 | |
| JP | H01 204860 | | 8/1989 | |
| JP | H02 65667 | | 5/1990 | |
| JP | H0265667 | U * | 5/1990 | B61B 1/02 |
| JP | H07 108931 | | 4/1995 | |
| JP | H07108931 | A * | 4/1995 | B61B 12/002 |
| WO | WO 95/30216 | | 11/1995 | |
| WO | WO-9530216 | A1 * | 11/1995 | B61B 12/06 |
| WO | WO 2010/066712 | | 6/2010 | |

(Continued)

OTHER PUBLICATIONS

Italian Search Report for Italian Application No. IT 2019000001097 dated Oct. 1, 2019.

*Primary Examiner* — S. Joseph Morano
*Assistant Examiner* — Cheng Lin
(74) *Attorney, Agent, or Firm* — Neal, Gerber & Eisenberg LLP

(57) ABSTRACT

A cable transportation system comprising: at least a cable; an upstream station and a downstream station between which the cable extends; a plurality of supporting intermediate structures for supporting the cable between the upstream station and the downstream station; a plurality of transporting units coupled above the cable in a configuration suspended in the void and free to swing; an alarm device configured for detecting the contact between the transporting units and the supporting intermediate structures when a threshold tilting angle of the transporting units is exceeded and for emitting a relative alarm signal.

17 Claims, 5 Drawing Sheets

(56) References Cited

FOREIGN PATENT DOCUMENTS

| | | | | |
|---|---|---|---|---|
| WO | WO-2010066712 A1 * | 6/2010 | ..... | B61B 12/002 |
| WO | WO 2019/007870 | 1/2019 | | |

* cited by examiner

CABLE TRANSPORTATION SYSTEM

PRIORITY CLAIM

This application claims the benefit of and priority to Italian Patent Application No. 102019000001097 filed on Jan. 24, 2019, the entire contents of which are incorporated by reference herein.

TECHNICAL FIELD

The present disclosure is included in the technical field of cable transportation systems. The term "cable transportation system" is understood to mean a system for the transport of passengers with at least one cable, in which a plurality of transporting units are moved in series, one after another, in a configuration suspended from the ground along a route, which extends between two terminal stations (known as the upstream and downstream station), in which the passengers can board and alight from the transporting units.

In particular, the technical field of the present disclosure comprises both "single-cable" cable transportation systems, in which the hauling cable also acts as a supporting cable for supporting the transporting units in a configuration suspended from the ground, and "two-cables" and "three-cables" transportation systems, in which, besides the hauling cable, one or two supporting cables are present respectively having the purpose of supporting the transporting units in a configuration suspended from the ground. As known, the hauling cable is driven in a ring and moved between the terminal stations, and the transporting units comprise special devices (for example, clamps) for staying coupled to the hauling cable at least in the section outside the stations. If at least one supporting cable is present, the latter is substantially fixed (i.e., not moved between the stations other than for periodic maintenance steps and only subject to limited movements due to the varying line load conditions), and the transporting units further comprise devices close to the clamp (for example, at least one roller) capable of sliding along the supporting cable. In the case of three-cables systems, the transporting units are provided with actual trolleys for sliding on the two supporting cables. Systems with two supporting cables (particularly for low inclines) can also be devoid of the hauling cable and provided with motorized trolleys.

The above-mentioned term: "in a configuration suspended from the ground" refers to the fact that the transporting units (at least in the stretch between the stations) do not rest, at the bottom, on any guiding or supporting structure as opposed to the technical field of transportation systems (also of the type with a hauling cable), in which the transporting units are guided and supported, at the bottom, by a fixed structure (for example, a rail). In fact, as will emerge below, neither in this last case do certain of the problems underlying the present disclosure arise.

BACKGROUND

Cable transportation systems are commonly used today, in which passengers are carried along a route inside special transporting units fed, one after another, between two terminal stations, known as upstream and downstream stations. In particular, the present disclosure relates to cable systems, in which such transporting units are moved in a configuration raised or suspended with respect to the ground level or with respect to other possible underlying fixed structures. In fact, this raised and suspended configuration is frequently advantageous when the conformation of the ground below, or other accompanying factors, do not make alternative land travel viable, in which the transporting units, such as, for example, the carriages of a train travel resting at the bottom on guides that, in turn, rest more or less directly on the ground. For example, such cable systems are used in the case in which the route to be covered involves significant jumps in altitude, including with considerable inclines. This route is typical of lift systems present in ski resorts/mountainous areas. In these types of systems, often, it is also necessary, for various reasons, to provide fixed supporting structures for the hauling cable and/or the supporting cables located along the route in an intermediate position between the downstream and upstream stations. One reason may be an excessive distance between the terminal stations, which is such as not to allow the cable to be arranged in a single span between the stations. Another reason may be the elevation profile of the path of the system if there are significant incline changes. In these cases, as in other non-listed cases, cable transportation systems are thus provided with one or more fixed intermediate structures for supporting the cables. Each fixed intermediate structure comprises a vertical supporting structure, such as, for example, a pylon or a pole, on top of which guiding devices for the cable are provided, for example, a series of rollers. These rollers act as a support for the hauling cable and can be arranged along a single row (known as a supporting or retaining roller conveyor) or along two overlapping rows between which the hauling cable is slid (double-action roller conveyor). In particular, these rows of rollers are installed on the top of the pylons by special fixed cantilever structures (also known as supporting heads), on the one side coupled to the pylon and on the other side supporting the aforesaid rollers. As known, this cantilever structure is not only present on one side of the pylon, but also on the opposite side, symmetrical to the pylon, so as to provide a substantially T-shaped fixed structure for supporting both the ascent and descent branches of the hauling cable. These cantilever structures are also configured for enabling a periodic inspection and maintenance of the rollers and to this end, they are provided with special platforms (protected with railings) for the service staff to walk on. If at least one supporting cable is present the latter is always supported at the head of the pylons in a special structure known as a shoe. At this shoe, the roller for rolling on the supporting cable rolls on the outer profiles of the shoe.

Current legislation prescribes a minimum safety distance, which must be present between these fixed supporting intermediate structures and the transporting units transiting along the system. It is also necessary to consider that the transporting units may tilt due to the presence of wind, both laterally (or make rolling movements around the axis defined by the hauling cable or advance directly in a tilted configuration) and longitudinally (or make pitching movements). Thus, the maximum admissible tilting of the vehicles is one of the design parameters of a cable system of these two types. On reaching and exceeding the critical wind speed, at which the transporting units tilt beyond a certain limit angle with respect to the gravity vertical, it is necessary to implement safety measures, such as reducing the advancing speed or stopping the system. For example, EP Patent No. 1837264 describes a cable transportation system provided with special sensors for monitoring the tilting of the transporting unit and consequently controlling the operation of the system.

However, in this scenario, it is also necessary to consider that the wind speed can also change relatively very quickly (so-called "gusts"). In this case, contact between the transporting units and the movable or fixed parts of the fixed intermediate structures (particularly with the platforms or cantilever supporting structures of the rollers or fixed supporting structures of the cables) cannot be excluded due to a lack of physical time needed to slow down or stop the system or due to the need to proceed with the operation for storing the transporting units in any case (an operation lasting about 30 minutes or more). The transporting unit, which comes into contact with the fixed intermediate structure, can also be hooked or blocked by the structure itself and, in such conditions, the transporting unit can fall to the ground or the hauling cable can slide in the clamp with consequent damage to the cable. Furthermore, in these conditions, the successive transporting units can hit the blocked one creating a relatively extremely dangerous situation.

Thus, in cable transportation systems, there is a need not only to monitor the tilting of the transporting units in transit, but also to have an immediate confirmation of any contact or collisions between the transporting units and the supporting intermediate structures arranged along the route.

SUMMARY

Thus, one purpose of the present disclosure is to provide a cable transportation system of the single-cable or two-cables type, capable of overcoming certain of the drawbacks highlighted by certain of the prior art. In particular, the main purpose of the present disclosure is to provide a cable transportation system capable of giving relative immediate confirmation of a possible impact between a laterally tilted transporting unit due to crosswind, and the fixed support structures arranged along the route between the upstream and downstream stations.

In accordance with these purposes, and depending on the general definition thereof, the present disclosure relates to a cable transportation system of the type with at least one cable (thus, single-cable, two-cables, three-cables systems, or systems with two supporting cables and a motorized trolley), in which a plurality of transporting units advance, one after another, between two terminal stations—upstream and downstream—in a configuration suspended in the void (also at a considerable height).

As stated previously, the term "suspended in the void" is understood to mean that the transporting units do not rest on any supporting or guiding structure at the bottom and that, on the contrary, they can perform rolling movements around the axis of the hauling cable to which they are coupled at the top (normally due to a suspension arm installed above a cabin or a chair). The cable system of the present disclosure can also be a portion of a greater hybrid system provided with a portion of a system configured as a cable system and of a rail portion, in which the transporting units rest, at the bottom, on this rail.

Considering such general premises, a cable system in which the solution offered by the present disclosure can advantageously be integrated comprises:

a) at least one cable;
b) an upstream and a downstream station between which the cable extends;
c) a plurality of supporting intermediate structures for supporting the cable between the upstream station and the downstream station;
d) a plurality of transporting units coupled at the top to the cable in a configuration suspended and free to swing (for example, rolling around the axis of the cable due to crosswind and/or longitudinal pitching).

Reviewing this list of characteristics, it is possible to specify some of them and make the following clarifications to further define the protective scope of the present disclosure.

The first characteristic (i.e., at least one cable) highlights the fact that the system, in which the present disclosure can advantageously be integrated, is a cable system, (i.e., a system, in which the transporting units are suspended to a cable to which they are coupled, such as clamped in the case of a hauling cable). In systems with a hauling cable, the latter is produced in the shape of a closed ring, sent back at the upstream and downstream stations, inside which there is a motorized pulley for moving the cable. Inside the stations, the transporting units unclamp from the hauling cable and advance (for example, by motorized rubberized wheels) so as to enable comfortable boarding/alighting of passengers, at a relatively low speed, without compromising the speed of the units outside the station and consequently, the hourly capacity of the system. In single-cable systems, in which only the aforesaid hauling cable is present, this also acts as a supporting cable. In two-cables and three-cables systems, these functions are divided between the hauling cable (advancing) and in the at least one supporting cable (support). In this case, the supporting cable is fixed and the transporting unit comprises at least one roller for advancing supported by the supporting cable and suspended in the void. Systems, which can integrate the present disclosure are hybrid systems, in which at least one advancing portion is also provided with the transporting units, which rest on guides, at the bottom (for example, rails).

Characteristic c) (i.e., a plurality of supporting intermediate structures for supporting the cable between the upstream and downstream stations) identifies the presence, in the system, of other fixed structures, for supporting the cable, arranged along the path between the upstream and downstream stations. In certain embodiments, these structures are vertical pylons or poles having a first end coupled to the ground and a second end where the cable is passed. These pylons are necessary for several reasons. For example, the distance between the upstream and downstream stations can be too great for a single span of hauling cable or the route can have varying inclines, which are such as to require, also in this case, the subdivision of the cable into two spans with a different inclination. Besides the aforesaid vertical pylon, the top of these supports comprises at least one cantilever supporting structure, which extends laterally (and, for example, at least a row of supporting rollers for the cable, specifically the hauling cable), and is constrained to the free end of the cantilever supporting structure. The latter serves to guarantee a correct safety distance between the vertical pylon and the transporting units in transit. The rows of rollers can be single (supporting or restraining roller conveyor) or superimposed (double-action roller conveyor); in the second case, the cable passes between these two rows. In both cases the grooves of the rollers are opportunely shaped to house both the cable and the clamp, which connects the cable to the relative transporting unit. The rows of rollers comprise outer shoes capable of supporting the cable and the clamp, including in the case of derailment. The cantilever structure also comprises a platform, in the shape of steps parallel to the row of rollers, to enable the periodic inspection of the same. For safety reasons, the platform is also provided with a fall-arrest railing. Two cantilever structures are usually provided, symmetrical to each other, to support both the outgoing and incoming branches of the hauling cable. If at least one supporting cable is present, a structure is also provided at the top of the pylons, known as a shoe, at which the rollers that roll on the supporting cable rest on the sides of the shoe.

According to characteristic d) (i.e., a plurality of transporting units coupled at the top to the cable in a configuration suspended in the void and free to roll around the hauling cable due to crosswind) the disclosure comprises a plurality of transporting units, which are coupled to the cable in a specific way (i.e., they are coupled to the cable "at the top") and they are free to perform rotations, such as lateral rotations (i.e., rolling around the hauling cable) or longitudinal rotations. In certain embodiments, this configuration is obtained with a cabin, a chair, or other passenger transporting structures, characterized by a substantially vertical supporting arm (said suspension), which extends, at the top, beyond the volume of the cabin or chairs. In the case of a cabin, this arm is often coupled, at the bottom, to the roof of the cabin. A coupling device is mounted on the opposite and upper end of the suspension (such as a clamp which is releasable for the aforesaid reasons) with the hauling cable and, possibly, a roller for advancing on the supporting cable, if present. Since at the bottom, the floor of the cabin or the bottom of the chair is not resting on any guiding or supporting structure, the transporting unit is free to rotate or swing around the axis of the hauling cable, including longitudinally. In technical detail, it is worth pointing out that the transporting unit "doesn't rotate" in relation to the cable but integrally with the same. In fact, the cable also being clamped, it is pulled to rotate around the axis thereof by the rotation of the cabin.

Due to these possible rolling and/or pitching movements in the case of wind the transporting units can advance in a tilted position with respect to the natural position (by gravity) in wind-free conditions. Thus, geometrically, the volume (for example, the side volume) of the transporting units increases as the wind increases. It is known to include instruments capable of monitoring the tilting of the transporting units and control devices capable of modifying the speed of the system in the case of strong wind. In the case of relatively strong gusts of wind, the transporting unit can take on a tilt, which is such (i.e., beyond a limit angle) so as to lead to the impact against the lower end of the cantilever structures (particularly the lower part of the platform) at the pylons. The potential contact points between the transporting unit and the cantilever structure, as well as the aforesaid limit angle can be estimated, from a design point of view, fairly accurately.

As mentioned previously, this possible impact may have relatively very dangerous consequences. For example, the transporting unit, which comes into contact with the parts of the fixed intermediate structure, can also be hooked or blocked by the structure itself and, after this, fall to the ground, or the hauling cable can slide in the clamps with consequent damage to the cable. Furthermore, this event can result in a pileup between the successive transporting units and the blocked unit. Thus, it is necessary to have immediate confirmation of a possible impact of this kind.

To solve this problem, in the most general formulation thereof, the present disclosure thus requires that the system be provided with an alarm device configured for detecting contact between the transporting units and the supporting intermediate structures and emitting an alarm signal. The power supply of these devices is not a technical limit because electrically fed equipment or sensors are currently provided in similar positions.

From a technical point of view, this disclosure can be implemented in many ways; for example, by providing contact sensors or probes on the transporting units and/or on the fixed intermediate structures at least at the relative portions affected by the impact. Among the many possible embodiments, a particularly advantageous one of an electromechanical type will be described below. This solution will be relatively extremely simple and easy to inspect and can also be assembled on pre-existing systems and can relatively easily be adapted to different geometric shapes of the portions affected by a possible impact.

In certain embodiments, the alarm device can be configured not only for emitting an alarm signal, but also for transmitting this signal to the system control unit, for example, the system's surveillance system. This control unit, in turn, can be configured for automatically blocking the system on receiving the alarm signal or it can implement different control logics based on the alarm received. In fact, the alarm signal can be a signal not only containing information about the impact, but also information about the entity of the impact and/or the position of the collision.

The particularly advantageous solution, which will be described with reference to the attached figures, requires that the alarm device be made by at least one string electrically connected to the system's surveillance system and arranged along outer portions of the supporting intermediate structures (such as on the lower face of the platform) at those positions most at risk of an impact. For example, according to the present disclosure, the string electrically connected to the system's surveillance system can also be an electric cable (e.g., a simple string not electrically fed in itself, but connected, such as stretched, to a terminal), in which the terminal recognises an excess or lack of tension and, in such case, transmits an electric alarm signal. In certain embodiments, the string can be arranged in a zig-zag to cover the entire lower surface of the platform. This string electrically connected to the system's surveillance system can be configured for emitting the alarm signal in the case of breaking, but also in the case of simply varying the extent of the tensioning. In this last case, the string is previously pre-tensioned in a controlled manner. This controlled pre-tensioning enables an increase in tension to be recognized (e.g., if the string does not break but is pulled by the vehicle) or a reduction in tension (e.g., in the case of breaking or deforming/breaking caused by a hooking element with consequent shortening of the "theoretical" length of the string). This string can be kept in position by providing for special supporting elements (for example, eyebolts, such as eyebolts made of frangible or flexible material so as not to create a potential interlocking point for the transporting units) and possibly, a structurally more rigid string around which to wrap the "electrical" string. The transporting units, for their part, can also be provided with special portions (for example, small localized protrusions made of rubber) configured for possibly impacting against the string.

As said previously, this example is particularly advantageous; however, it is only one of the various embodiments of the disclosure. For example, it is possible to provide the exact opposite of the above (i.e., the string arranged on portions of the transporting units, for example, along the periphery of the roof of a cabin, and possible protrusions made of rubber on the lower surface of the platforms).

Additional features are described in, and will be apparent from the following Detailed Description and the figures.

BRIEF DESCRIPTION OF THE DRAWINGS

Further features and advantages of the present disclosure will become clear from the following description of a non-limiting embodiment thereof, with reference to the figures of the accompanying drawings, wherein.

DETAILED DESCRIPTION

Figure 1:
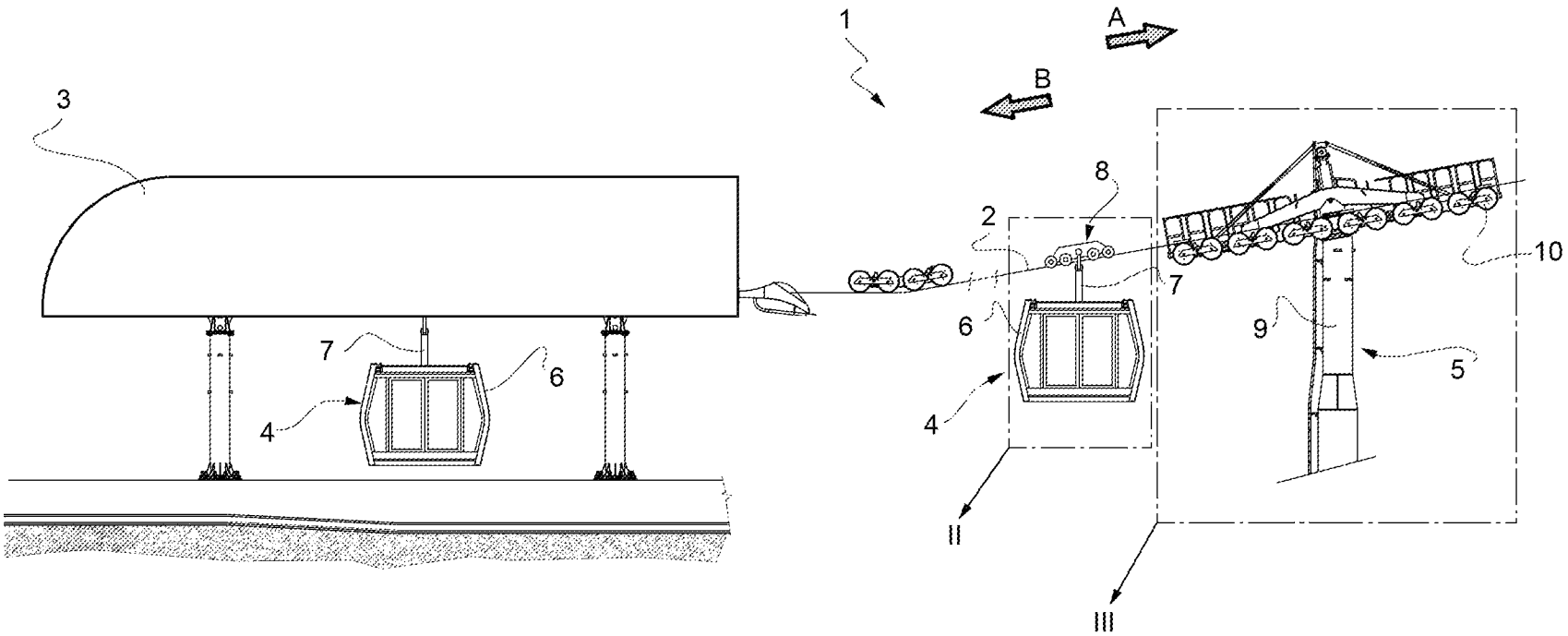
FIG. 1 is a schematic view of a portion of the cable transportation system.
Figure 2:
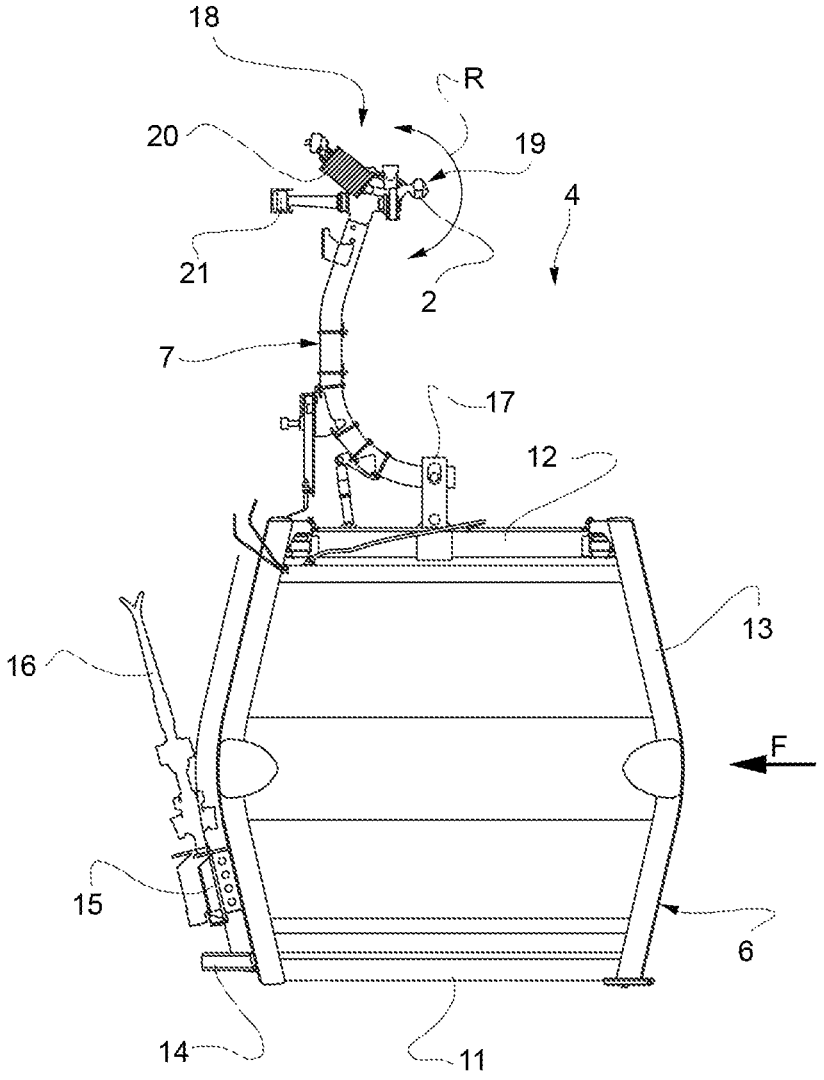
FIG. 2 is a schematic view of the part indicated in FIG. 1 with reference II (i.e., a transporting unit in the form of a cabin)

With reference to the accompany figures, FIG. 1 schematically shows a portion of a cable transportation system globally represented with reference 1. In particular, a cable system is visible in FIG. 1, in which the solution proposed by the present disclosure is integrated, offering considerable advantages in terms of safety. This cable system 1 is of the single-cable type and thus comprises a single cable 2, which serves the dual purpose as a supporting cable and a hauling cable. This cable 2 is sent back in a ring by two pulleys, including a motorized one, between two terminal stations, in particular, an upstream station (not shown) and a downstream station 3, thus identifying an ascent branch and a descent branch. The arrows A and B in FIG. 1 indicate the advancing directions of the ascent and descent branches of the cable 2. One of the multiple transporting units 4 usually present in a system of this type along both the ascent and descent branches of the cable is represented in FIG. 2. In particular, a first transporting unit 4 is located at the downstream station 3. Usually, inside the stations, the transporting units 4 unclamp from the cable 2 in order to be able to advance more slowly (and enable the passengers to board and to alight relatively easily) without reducing the travelling speed of the line between one station and another. The second transporting unit 4 shown is travelling along the ascent branch of the cable 2 and it is arranged between the downstream station 3 and a first fixed supporting intermediate structure 5 arranged along the route to divide the cable 2 into spans. Although both the transporting unit 4 and the fixed supporting intermediate structure 5 will be the subject of the description of FIGS. 2 and 3, in FIG. 1 it is already possible to appreciate how the transporting unit 4 in the example shown comprises a cabin 6 at the bottom and a supporting arm 7 (said suspension) at the top, which connects it to the cable 2. As can be seen in FIG. 2 the cabins 6 (at least in the section outside the stations) are suspended in the void, not resting at the bottom on any lower structure and thus, by virtue of the fact of being coupled, at the top, to the cable 2, they may be subject to rolling movements around the axis of the cable 2, for example, due to the effect of crosswind, as well as to longitudinal pitching movements. The device, which connects the supporting arm 7 to the cable 2, is schematically shown with reference 8 in FIG. 1. Such device can comprise a releasable clamp and/or at least one roller (if the system is of the two-cables type with the roller coupled to the supporting cable). Finally, it is possible to note how, in FIG. 1, the fixed supporting intermediate structure 5 comprises a vertical pylon at the top of which a row of rollers 10 is present for supporting the cable 2.

As said previously, FIG. 2 shows a schematic view of the part indicated in FIG. 1 with reference II (i.e., a transporting unit 4 comprising a relative cabin 6). In particular, FIG. 2 shows a front view of the unit 4 along the axis of the cable 2. As can be seen, the unit 4 comprises a cabin 6 provided with a floor or a bottom 11, a roof 12, and side walls 13. At one side of the side walls 13 there is a movable door (not shown), a step 14 for helping passengers to enter and exit and receptacles 15, in which objects, such as skis 16, rackets or other can be placed. The unit 4 further comprises a supporting arm 7 (said suspension) having a first lower end 17 coupled to the roof 12 of the cabin 6 by an intermediate frame, and an upper end 18 provided with a clamp 19 for releasable coupling to the cable 2. The clamping mechanism is of the type known and comprises a spring 20 and an actuation lever 21, which is moved in the station, by specially shaped guides, to overcome the force of the spring 20 and release the cable 2 from the clamp 19. As can be seen, the bottom 11 of the cabin 6, not resting on any guiding or supporting structure, is suspended in the void and thus, due to its coupling to the cable 2 placed at the top of the roof 12, the cabin 6 can swing (for example, rolling, schematized with R in FIG. 2, around the axis defined by the cable 2). In particular, this rolling R can be generated by the presence of a lateral force (schematized with F in FIG. 2) for example, due to the presence of wind. Thus, it is possible that, in some circumstances, the cabin 6 is in a tilted position, occupying a lateral volume greater than the volume shown in FIG. 1, where no lateral force F is present.

Figure 3:
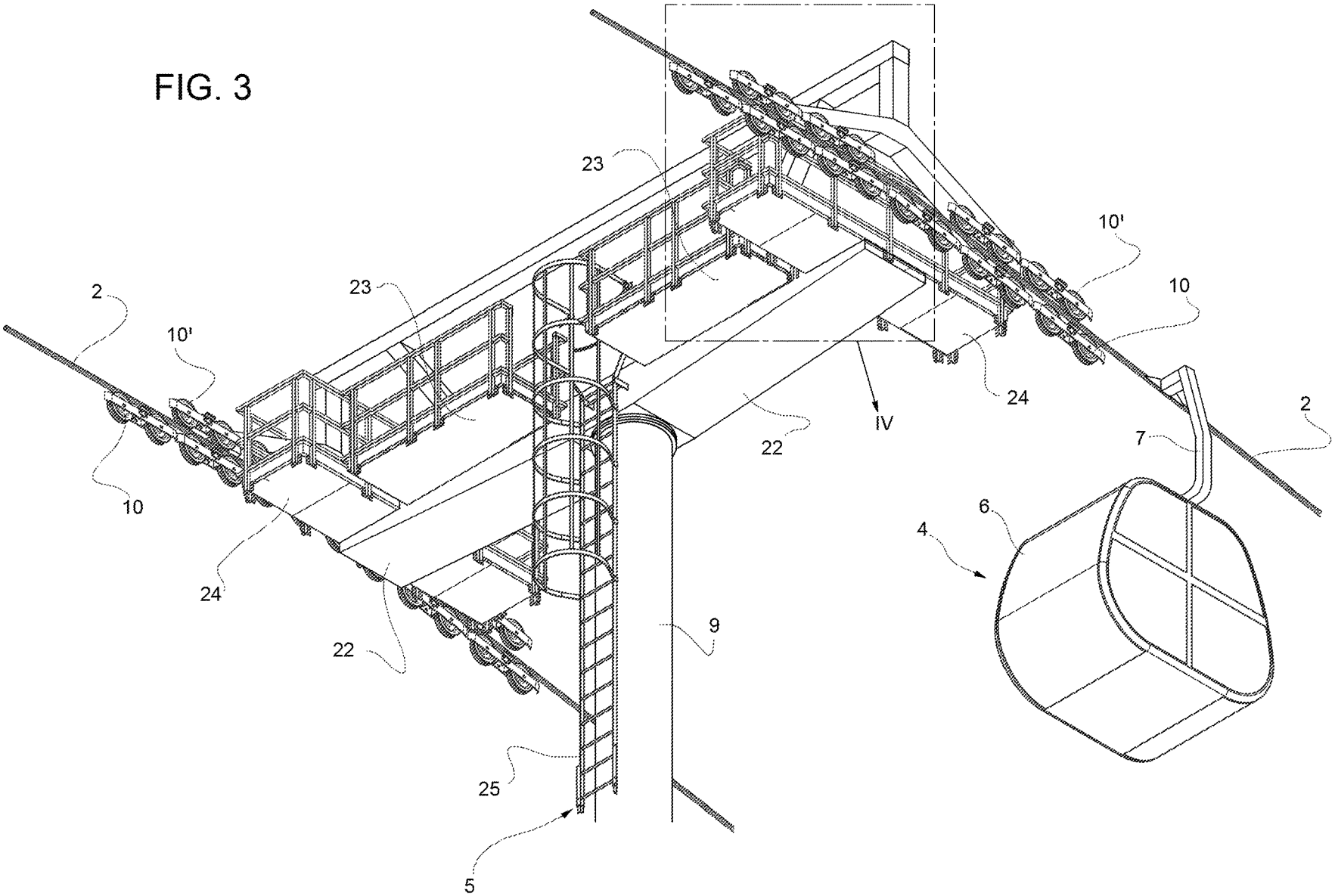
FIG. 3 is a schematic view of the part indicated in FIG. 1 with reference III (i.e., a fixed supporting intermediate structure of the hauling cable in the form of a vertical pylon)
Figure 4:
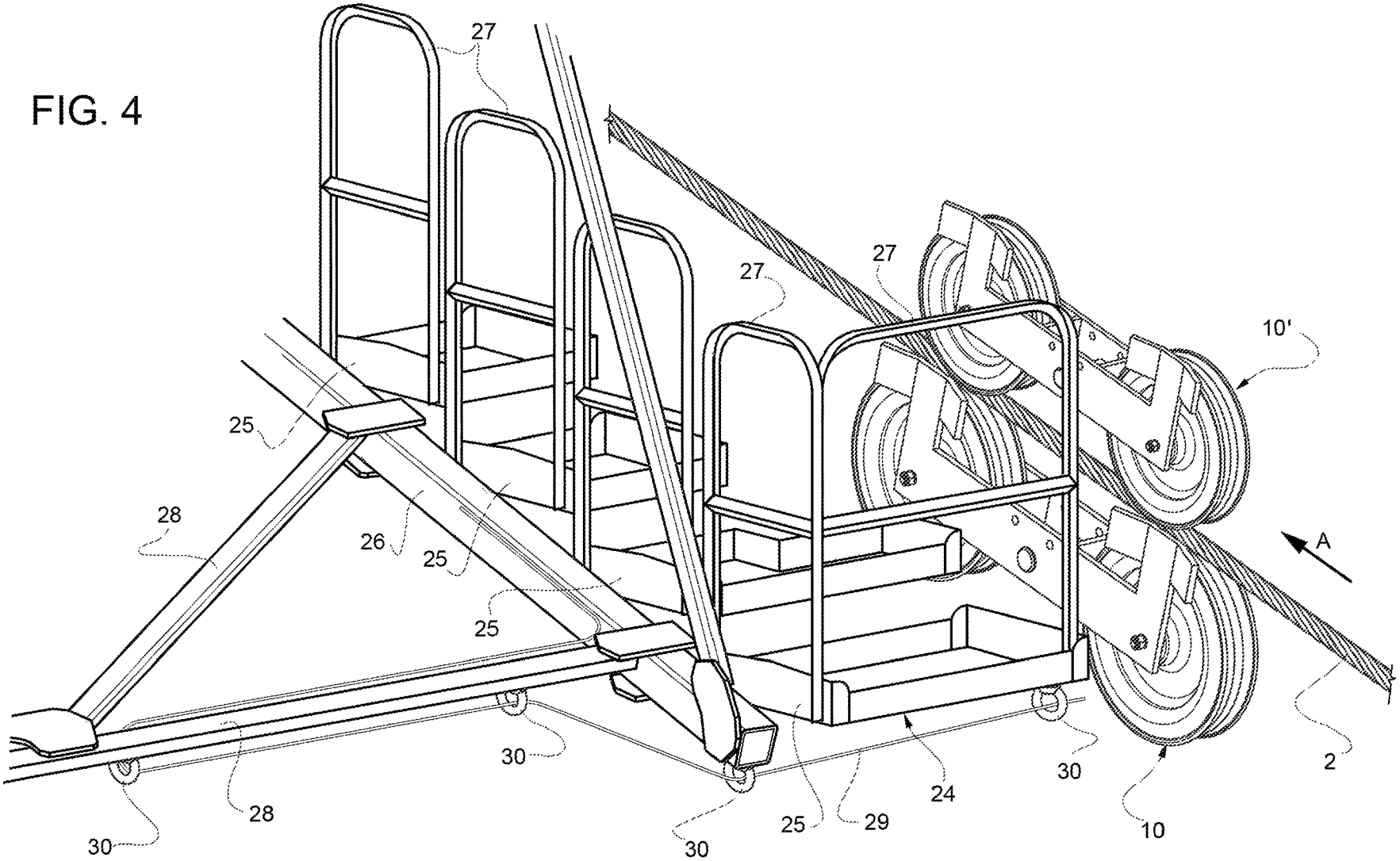
FIG. 4 shows an enlarged schematic view of the detail indicated in FIG. 3 with reference IV (i.e., a portion of the fixed supporting intermediate structure provided with an example of an alarm device according to the present disclosure)

As said previously, FIG. 3 shows a schematic view of the part indicated in FIG. 1 with reference III (i.e., a fixed supporting intermediate structure for the cable 2 comprising a pylon 9). In particular, FIG. 3 substantially shows the upper half of this pylon 9 and allows us to appreciate how the rollers 10, mentioned previously, are supported by this structure 5. The upper end of the pylon 9 comprises two cantilever supporting structures 22 that extend symmetrically to the pylon 9 in a cantilever fashion. Each external end of these cantilever structures 22 supports a double row of rollers 10, 10' overlapping each other, creating a passage for the ascent and descent branches of the cable 2. These cantilever structures 22 also comprise a walkway 23 and a platform 24 to enable the inspection of the rollers 10, 10'. It is possible to access this walkway 23 and platform 24, for example, by a ladder 25, which runs along the pylon 9. FIG. 3 shows an illustration in which crosswind does not act against the cabins 6, which are, in fact, in a non-tilted position. However, as regards the description with reference to FIG. 2 (which can also be applied to systems with supporting cables), with crosswind F, the cabins 6 roll around the axis of the cable 2 and can also exceed a limit tilting angle at which they collide against the lower wall of the platform 24. FIG. 4 shows an enlargement of the detail indicated in FIG. 3 with reference IV and in which an embodiment of the alarm device of the present disclosure is visible, configured for detecting the impact between the transporting unit 4 and the fixed structure 5.

Figure 5:
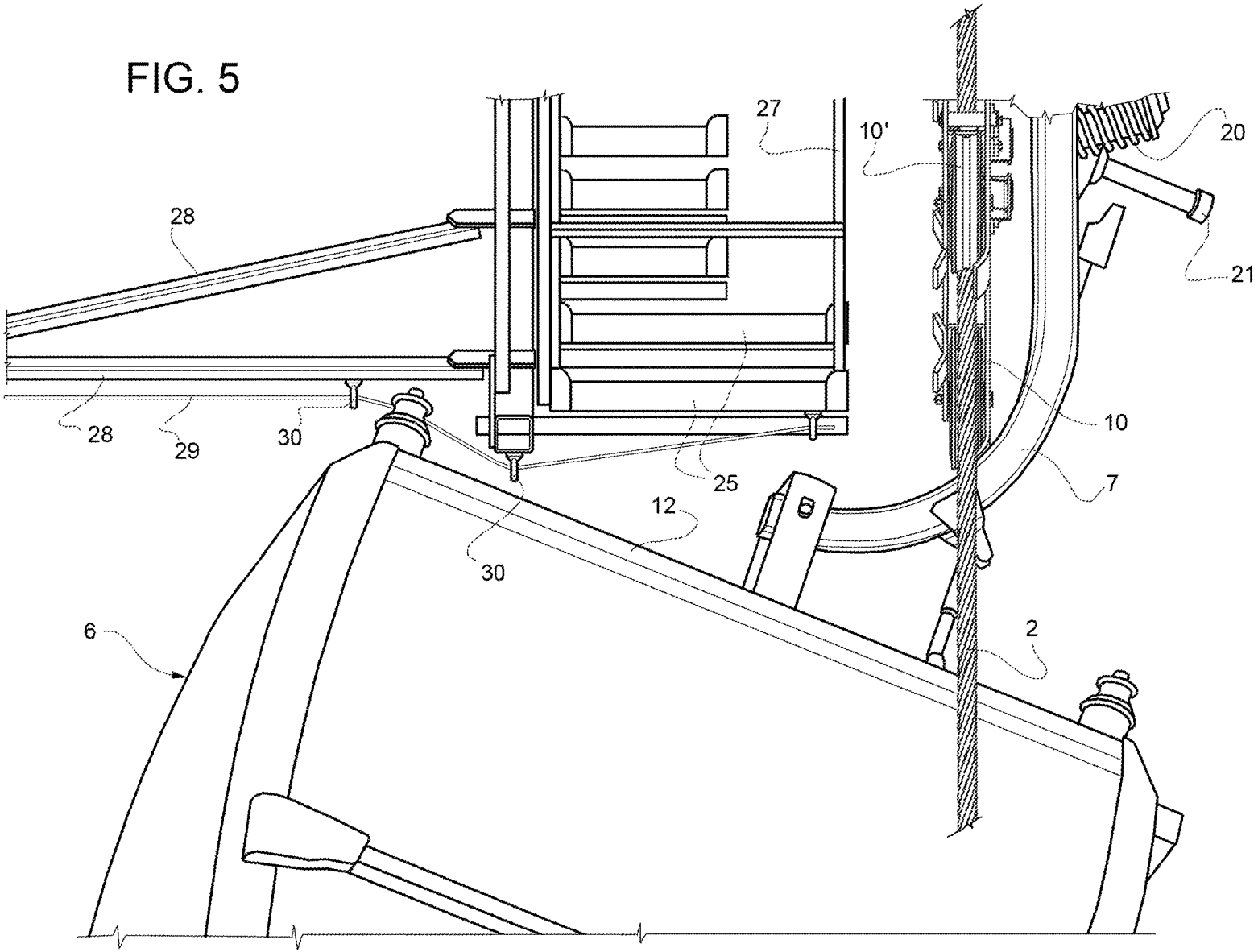
FIG. 5 shows a schematic view of the operation of the alarm device in FIG. 4 during an accidental impact of a transporting unit against a portion of a fixed supporting intermediate structure of the system.

Thus, FIG. 4 shows a portion of the two superimposed rows of rollers 10 10', inside which the cable 2 passes, and a portion of the platform 24. In FIG. 4 the platform 24 is made by a series of stairs or steps 25 fixed to a common bracket 26 substantially parallel to the rows of rollers 10 10'. Each step 25 is also provided with a protective railing 27. The brackets indicated in FIG. 4, such as reference 28, represent the bracings of the cantilever structure 22, which connects the rollers to the pylon 9, while reference A indicates the advancing direction of the cable 2 (and thus, the advancing direction of the transporting units 4). According to the example shown, an electric string 29 or a string/cable electrically/electronically connected to the system's surveillance system 1 is arranged along the lower surface of the first step 25, on the side of the bracket 28 and the support 26. In particular, the string 29 is configured for emitting and transmitting an alarm signal in case of being cut or if there is a variation in the stretching with respect to the initial stretching. The arrangement of this electric string 29 is not random. In fact, this string runs right along the portions, which can come into contact with portions of the cabin 6, in a tilted position, due to relatively strong gusts of wind. This unlucky case is shown in FIG. 5 where it is possible to note how, in case of relatively strong wind (i.e., a wind such as to tilt the cabins 6 beyond a limit angle), a portion of the intermediate frame 12 comes into contact with the string 29, thus generating an alarm signal. This alarm can be managed in various ways and, depending on the devices used, the signal can comprise various information. For example, the alarm signal can be sent to a specific control unit, which commands the immediate stopping of the system 1. As can be seen in FIGS. 4 and 5, the string 29 is supported by special eyebolts 30.

Finally, changes and variations can clearly be made to the disclosure described herein, without departing from the scope of the accompanying claims. Accordingly, various changes and modifications to the presently disclosed embodiments will be apparent to those skilled in the art.

The invention claimed is:

1. A cable transportation system comprising:
a cable;
an upstream station;
a downstream station;
a supporting intermediate structure supporting the cable between the upstream station and the downstream station;
a transporting unit coupled to the cable in a configuration free to swing; and
an alarm device comprising a string arranged along a plurality of portions of the supporting intermediate structure in a plurality of positions, the alarm device configured to:
detect an impact of the string by the transporting unit responsive to the transporting unit exceeding a threshold tilting angle, and
emit an alarm signal.

2. The cable transportation system of claim 1, further comprising a control unit, wherein the alarm device is configured to transmit the alarm signal to the control unit and the control unit is configured to issue a stop command responsive to the alarm signal being received.

3. The cable transportation system of claim 1, wherein the string is at least one of electrically fed and stretched to an electrical terminal.

4. The cable transportation system of claim 1, further comprising a plurality of supports coupled to the supporting intermediate structure and supporting the string.

5. The cable transportation system of claim 4, wherein the plurality of supports comprise a plurality of eyebolts made of frangible material.

6. The cable transportation system of claim 1, wherein the string is wrapped around a rigid supporting string.

7. The cable transportation system of claim 1, wherein the alarm signal is emitted responsive to at least one of a breaking of the string and a variation of a stretching of the string.

8. The cable transportation system of claim 1, wherein:
the transporting unit comprises:
a cabin, and
a suspending arm having a first lower end coupled to the cabin and a second upper end associated with a coupling device coupled with the cable,
the supporting intermediate structure comprises:
a vertical pylon having a first end coupled to the ground and a second end, and
a cantilever supporting structure laterally extending from the second end of the vertical pylon, wherein the string is coupled to the cantilever supporting structure.

9. The cable transportation system of claim 8, wherein the cantilever supporting structure comprises a platform and the string is coupled to a lower portion of the platform.

10. The cable transportation system of claim 9, wherein the string is coupled to the lower portion of the platform along a zig-zag path configured to cover substantially the entire lower portion of the platform.

11. The cable transportation system of claim 1, wherein:
the transporting unit comprises:
a chair, and
a suspending arm having a first lower end coupled to the chair and a second upper end associated with a coupling device coupled with the cable,
the supporting intermediate structure comprises:
a vertical pylon having a first end coupled to the ground and a second end, and
a cantilever supporting structure laterally extending from the second end of the vertical pylon, wherein the string is coupled to the cantilever supporting structure.

12. The cable transportation system of claim 11, wherein the cantilever supporting structure comprises a platform and the string is coupled to a lower portion of the platform.

13. The cable transportation system of claim 12, wherein the string is coupled to the lower portion of the platform along a zig-zag path configured to cover substantially the entire lower portion of the platform.

14. A cable transportation system comprising:
an alarm device comprising a string configured to be arranged along a plurality of portions of the supporting intermediate structure in a plurality of positions, the alarm device configured to:
detect an impact of the string by a transporting unit coupled to a cable in a configuration free to swing and a supporting intermediate structure supporting the cable between an upstream station and a downstream station, wherein the impact is detected responsive to the transporting unit exceeding a threshold tilting angle, and
emit an alarm signal.

15. The cable transportation system of claim 14, wherein the string is at least one of electrically fed and stretched to an electrical terminal.

16. The cable transportation system of claim 14, wherein the alarm signal is configured to be emitted responsive to at least one of a breaking of the string and a variation of a stretching of the string.

17. A method of operating a cable transportation system, the method comprising:

detecting, by an alarm device comprising a string arranged along a plurality of portions of a supporting intermediate structure in a plurality of positions, an impact of the string by a transporting unit coupled to a cable in a configuration free to swing and a supporting intermediate structure supporting the cable between an upstream station and a downstream station, wherein the impact is detected responsive to the transporting unit exceeding a threshold tilting angle, and emitting, by the alarm device, an alarm signal.

* * * * *